US012090357B2

(12) United States Patent
Gamboa

(10) Patent No.: US 12,090,357 B2
(45) Date of Patent: Sep. 17, 2024

(54) HANDHELD WEIGHT EXERCISE SYSTEM

(71) Applicant: Ricardo Gamboa, Monterey Park, CA (US)

(72) Inventor: Ricardo Gamboa, Monterey Park, CA (US)

(73) Assignee: Platos LLC, Monterey Park, CA (US)

( * ) Notice: Subject to any disclaimer, the term of this patent is extended or adjusted under 35 U.S.C. 154(b) by 66 days.

(21) Appl. No.: 17/686,221

(22) Filed: Mar. 3, 2022

(65) Prior Publication Data

US 2022/0280829 A1 Sep. 8, 2022

Related U.S. Application Data

(60) Provisional application No. 63/155,920, filed on Mar. 3, 2021.

(51) Int. Cl.
*A63B 21/075* (2006.01)
*A63B 21/06* (2006.01)
*A63B 21/072* (2006.01)

(52) U.S. Cl.
CPC ..... *A63B 21/075* (2013.01); *A63B 21/0604* (2013.01); *A63B 21/072* (2013.01)

(58) Field of Classification Search
CPC ..... A63B 21/075; A63B 21/0604; A63B 21/0722; A63B 21/0728; A63B 21/072; A63B 21/00058–00065; A63B 21/0724; A63B 21/0726; A63B 21/06; A63B 21/0601; A63B 21/0605; A63B 21/0607; A63B 2225/09
See application file for complete search history.

(56) References Cited

U.S. PATENT DOCUMENTS 1,991,520 A * 2/1935 Postl ..... A63B 21/0728 482/108
4,199,140 A * 4/1980 Ferretti ..... A63B 21/0728 482/106
4,913,422 A 4/1990 Elmore et al.
7,517,305 B2 * 4/2009 Lien ..... A63B 21/0728 482/106
8,992,389 B2 * 3/2015 Abel ..... A63B 23/03541 482/51
9,138,610 B2 * 9/2015 Lovegrove ..... A63B 21/0004
10,420,978 B2 * 9/2019 Wang ..... A63B 21/072
2002/0091044 A1 4/2002 Lien et al.
2002/0115539 A1 8/2002 Krull
2003/0199368 A1 10/2003 Krull
2006/0073948 A1 * 4/2006 Lincir ..... A63B 21/06 482/106
2013/0184129 A1 7/2013 Lovegrove et al.

OTHER PUBLICATIONS

International Search Report for the International application No. PCT/US22/18769 dated May 16, 2022 (Year: 2022).*

* cited by examiner

*Primary Examiner* — Loan B Jimenez
*Assistant Examiner* — Kathleen M Fisk
(74) *Attorney, Agent, or Firm* — KELLY & KELLEY, PLLC

(57) ABSTRACT

A handheld weight exercise system includes a plurality of plates of varying weights. Each plate includes at least one connector assembly for detachably connecting the plate to another adjacent plate. Each plate includes a handhold aperture, which is alignable with a handhold aperture of an adjacent plate when the two are connected to one another, for grasping and moving the one or more plates.

12 Claims, 8 Drawing Sheets

HANDHELD WEIGHT EXERCISE SYSTEM

RELATED APPLICATION

This application claims the benefit of U.S. Provisional Application No. 63/155,920, filed on Mar. 3, 2021.

FIELD OF THE INVENTION

The present invention is generally concerned with free weights for exercising. More particularly, the present invention is related to handheld weight exercise system comprising weight plates which can be stackably attached to one another for exercise.

BACKGROUND OF THE INVENTION

Free weights are often used for exercising and strength conditioning. Free weights include any weight which can be picked up and moved around. Unlike machines, where the movement and the user are fixed, free weights allow a user to work in any range of motion he or she would like. Free weights act as resistance to the user's movements, and thus strengthens and can increase muscle mass of the muscles and areas of the body used in performing the motions.

Free weights include barbells, wherein an elongated bar is configured to receive weights on either end thereof. The barbell itself has an amount of weight, and the weight can be increased by adding weights, typically plated weights, on the ends of the bar and securing the weights in place with clips or other locking mechanisms. Barbells may be used in performing various exercises, including bench press chest workouts, bicep curls, squats and the like.

The use of barbells does have certain drawbacks, however. A user must operate the barbell with both hands. Thus, both of the user's hands and arms are similarly engaged with the barbell at all times in order to be able to support and either lift or push the barbell. The barbell itself can be of a significant amount of weight, perhaps more weight alone than the user or the exercise can accommodate. Furthermore, use of a barbell often requires additional equipment, such as a bench or a rack to safely perform the exercises.

Dumbbells are another type of free weight. Dumbbells come in a variety of sizes and configurations and weights. Generally speaking, however, a dumbbell is comprised of a central grip which the user can extend his or her hand around in order to grip and lift the dumbbell, and an equal amount of weight on either end of the grip. The dumbbell may be comprised of a unitary mass, wherein the amount of weight of the dumbbell is fixed. In other cases, the grip of the dumbbell acts as a small barbell onto which weights can be placed on either end and secured in place.

However, dumbbells also have drawbacks. Similar to barbells, it takes time and effort in order to increase or decrease the amount of weight added on, equally, to each end of the dumbbell or barbell and then secure the weights in place. At times, the clips or locking mechanisms are either not properly secured or weaken and fail, which can cause weights to shift on that side of the barbell or dumbbell, which can be dangerous to the user. In the case of integrally formed dumbbells, a large number of dumbbells of varying weights must be purchased and available in order to perform workouts of varying intensity. In a group setting, such as at a gym, this can require the purchase and stocking of dozens of different dumbbell. When dumbbells of a particular weight are being used by others, a patron of the gym may need to wait until the desired dumbbell weight is available to perform his or her exercises.

Kettle bells are also a form of free weight. Kettle bells are typically comprised of a generally spherical mass representing a given weight having a handle extending therefrom. The user can lift the kettle bells with one or two hands and perform various movements and motions in order to strengthen muscles and body parts.

The kettle bells have similar disadvantages as dumbbells. They are of a fixed weight, requiring the user or gym to purchase a wide variety and number of kettle bells in order to provide the user kettle bells of varying weights to perform different exercises or to increase or decrease the intensity of the exercise. Also, similar to integral dumbbells, kettle bells can take up a significant amount of storage space.

Accordingly, there is a continuing need for free weights and a free weight system which enables the user to work in any range of motion to perform a variety of exercises and increase strength, easily enabling the user to increase or decrease weight, without requiring additional devices or machines, and while having a relatively small footprint and storage space requirement. The present invention fulfills these needs, and provides other related advantages.

SUMMARY OF THE INVENTION

The present invention is directed to a handheld weight exercise system. The handheld weight exercise system of the present invention comprises a free weight system, enabling the user to work in any range of motion to perform a variety of exercises and increase strength. The user is able to easily increase or decrease the weight used. The system of the present invention also provides a relatively small footprint and storage space requirement.

The handheld weight exercise system of the present invention generally comprises two or more plates each having a different weight in comparison with at least one of the other plates. Each plate includes at least one connector assembly for detachably connecting the plate to another of the plates. Each plate includes a handhold aperture which is alignable with the handhold aperture of an adjacent plate when the two are connected to one another. The handhold apertures may each have an oblong configuration enabling four fingers of a user to be inserted therethrough.

The plates may comprise discs having a circular configuration and generally planar upper and lower surfaces. An elastomeric band may be disposed around a periphery of each plate. The band may have a beveled outer surface forming a fingerhold.

The at least one connector assembly may comprise a first locking member associated with one of the plates and a second locking member associated with an adjacent plate. The locking members cooperatively and releasably connect the adjacent plates to one another.

The first locking member may comprise a peg extending from the surface of the associated plate. The peg may comprise a post extending vertically from the surface of the associated plate, and an enlarged head at an end of the post opposite the surface of the associated plate.

The second locking member may comprise a slot associated with the adjacent plate for receiving at least a portion of the peg. The slot may comprise a recess in the adjacent plate having an open-faced aperture for receiving the head of the peg. The slot may also comprise a locking portion for slidably receiving the peg therein as the adjacent plates are rotated with respect to one another to align the handhold apertures.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in a handheld weight exercise system. More particularly, the present invention is directed to a free weight, in the form of a plate, which can be grasped and held by the user and moved to perform various exercises for building strength, speed, flexibility, balance and muscle mass. As will be more fully described herein, the amount of weight held in each hand by a user may be quickly and easily increased or decreased, without the need for bars or grips and associated mechanisms for attaching weight to such a bar or grip, as is the case with conventional dumbbells using weights which can be added or subtracted from the bar or grip. As such, the handheld weight exercise system of the present invention overcomes many of the drawbacks and disadvantages of other free weights, as mentioned above.

Figure 1:
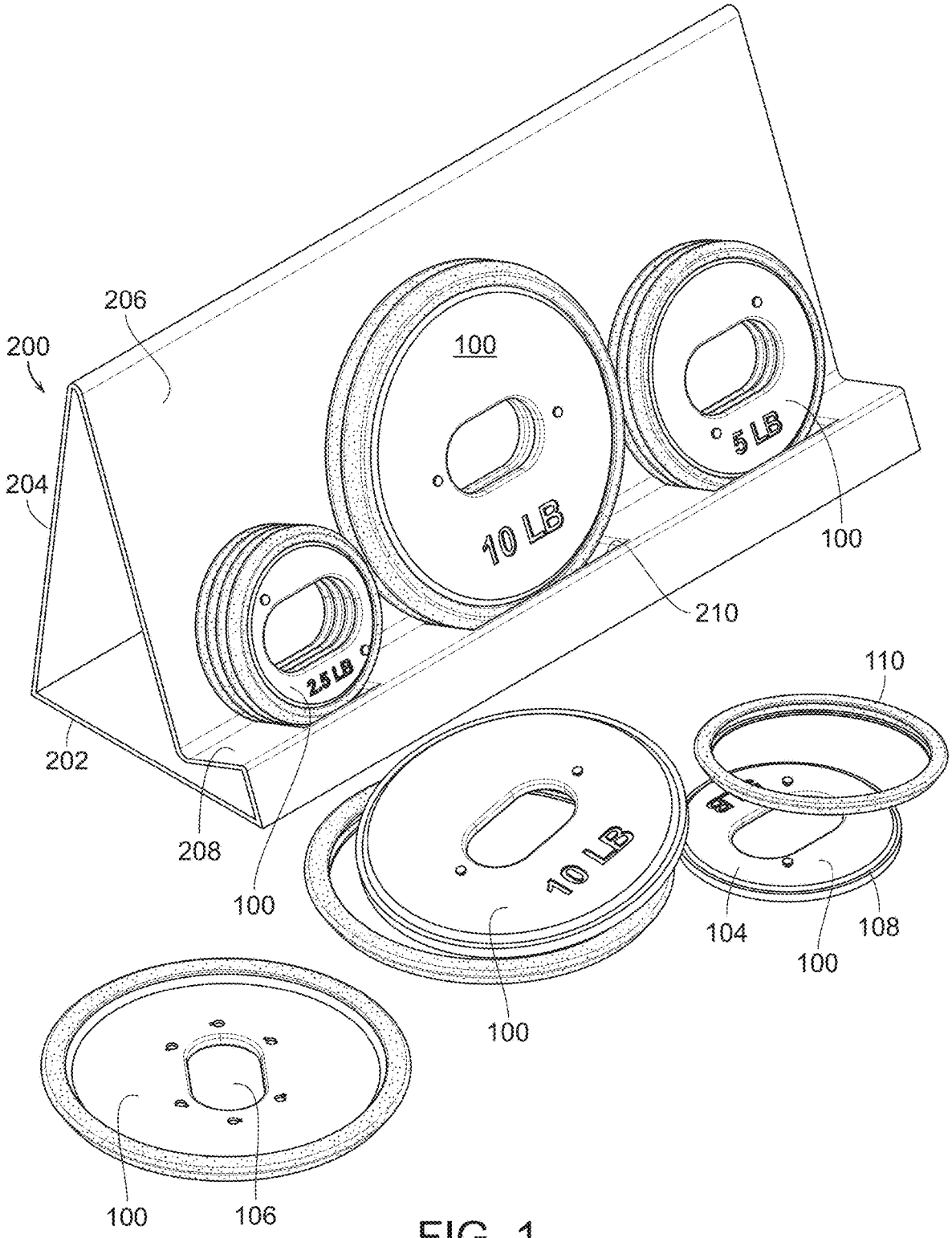
FIG. 1 is a perspective and environmental view of a handheld weight exercise system embodying the present invention, including a plurality of plates of varying weight, as well as a stand for holding and storing the plates.
Figure 2:
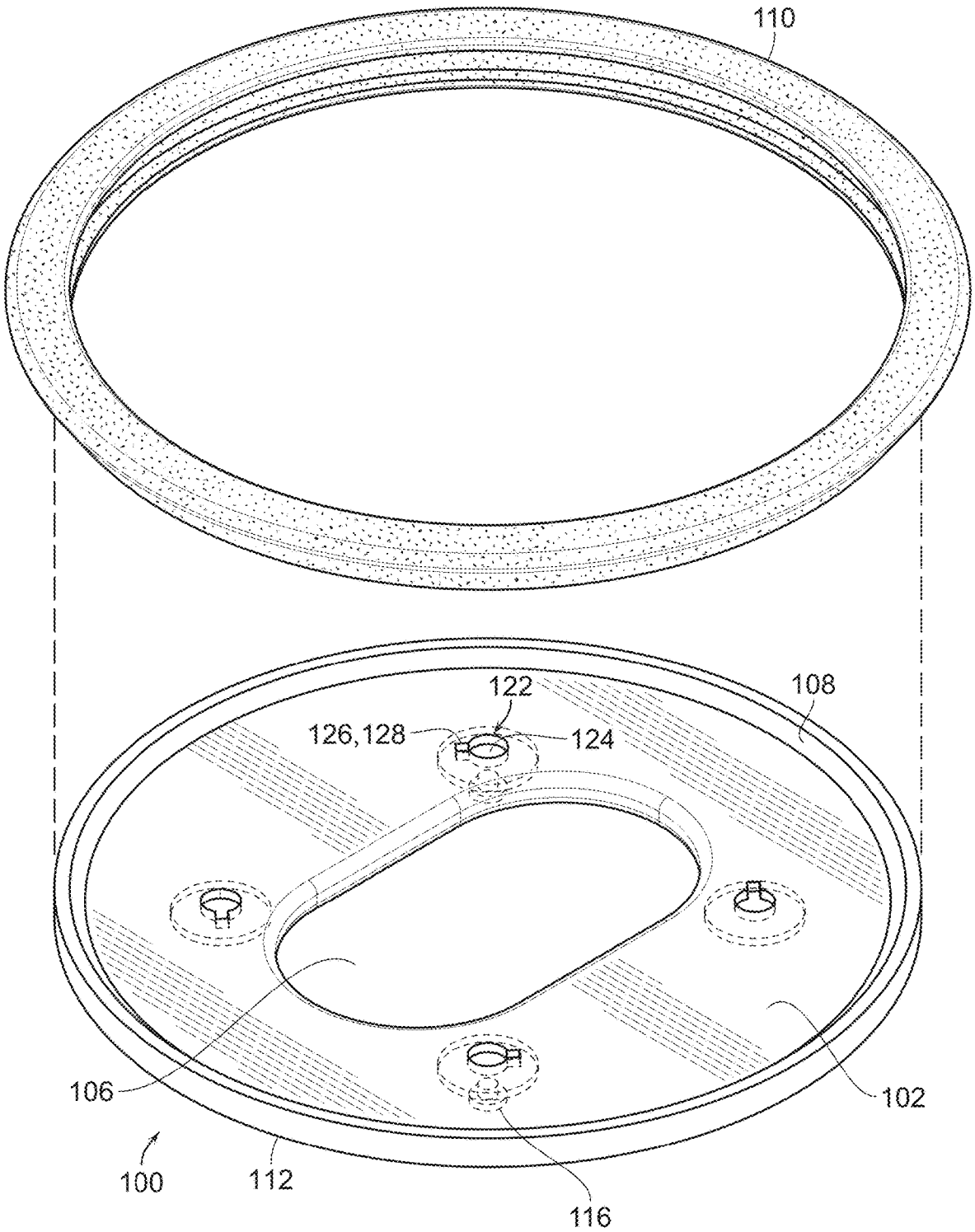
FIG. 2 is an exploded perspective view of a handheld plate embodying the present invention.
Figure 3:
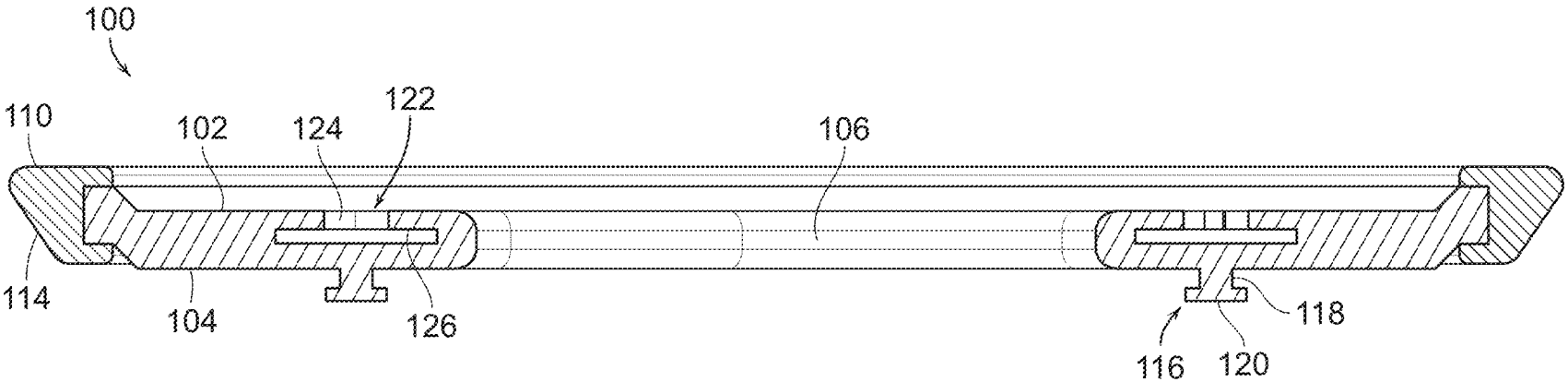
FIG. 3 is a cross-sectional view of the plate of FIG. 2.

With reference now to FIGS. 1-3, the handheld weight exercise system of the present invention comprises two or more plates 100. Preferably, the plates have a combination of different weights in comparison with at least one of the other plates 100. For example, as illustrated in FIG. 1, there are plates 100 that are 2.5 lbs. in weight, 5 lbs. in weight, and 10 lbs. in weight. There may be multiple plates 100 of the same weight, as shown in FIG. 1. As illustrated, the plates 100 may comprise discs having a circular configuration and generally planar upper 102 and lower 104 surfaces. Preferably, the plates 100 are sufficiently thin so as to be easily grasped by a user, and also so as to be connected to additional one or more plates, such as in stacked relation, and still be capable of being grasped by the user and moved in a desired motion for exercise purposes.

With continuing reference to FIGS. 1-3, each plate includes a handhold aperture 106, which is typically formed in a central portion of the plate 100. As illustrated, the handhold apertures 106 have a size and configuration so as to enable four fingers of the user to be inserted therethrough. The oblong-configured aperture 106 illustrated herein enables a user to insert all of his or her four fingers therethrough so as to grasp and hold the plate 100, with the user's fingers being positioned on one side of the plate and the user's palm and thumb being applied to the opposite surface of the plate 100 so as to grasp and hold the plate. The user can then lift, swing, curl, and otherwise move the weighted plate 100 in any direction or movement as the user sees fit in order to exercise.

The plate 100 is typically comprised of metal, but may be comprised of any other suitable material that provides the desired weight while enabling the plate to remain relatively thin and not so large in diameter so as to be unwieldy. The plates 100 may be covered or coated with a material or have texture added thereto, to facilitate the gripping by the user's hands. Such tacky-type material may be paint, or other material sprayed or attached thereto. The plates 100 may be covered with a clamshell mold. The paint or material added onto the plates 100 may be of varying colors, such as to represent the differing weights of the plates. Additionally, or alternatively, weight designations may be associated with the plates 100, such as by during the molding process of the plate, by paint or other marking material, imprinting, or the like.

A peripheral ridge 108 may extend from the plate 100, which can be used for gripping or stacking purposes. The ridge 108 may extend generally vertically from one or more of the upper and lower surfaces 102 and 104 or generally along the same plane as the plate 100. The ridge 108 may enable the user to more easily lift the plate 100, such as if the plate is in an at-rest position or a horizontal surface or vertical surface or in a stacked relation relative to other plates 100.

The plate 100 may have a peripheral beveled outer face, which forms a fingerhold. Such beveled outer face enables the user to more easily grasp the plate 100 when lifting it from a horizontal or vertical flat surface or from a stack of other plates 100 or the like. Such a beveled edge easily enables a user's fingertips to be inserted thereon a lift the plate 100, which will also protect damage to the user's fingertips, fingernails and the like, and then enable the user to insert his or her fingers through the handhold aperture 106 of the plate 100. The beveled edge may be formed during the manufacturing of the plate 100, such as during a molding process, or may be created when the plate 100 is covered with the clamshell mold or otherwise covered with another material.

In a particularly preferred embodiment, as illustrated, a band 110 is disposed around a periphery of each plate 100. The band 110 may be configured so as to receive the outer peripheral edge of the plate 100, which may or may not include the raised ridge 108. It will be understood that the outer peripheral edge 112 of the plate may have varying configurations, such as being square, rounded, including a raised ridge or lip 108, etc., and the band 110 can have an inner configuration substantially mating with the outer profile and configuration of the peripheral edge 112 of the plate 100.

The band 110 may be detachably connectable to the plate 100. Alternatively, it may be formed during the manufacturing process, such as being integrally formed the plate 100, or after the plate 100 has been molded, etc. the band 110 is permanently attached to the peripheral edge 112 thereof. The band 110 may also be attached to the plate 100 after the plate has received a neoprene, vinyl, or other coating.

Preferably, the band 110 is comprised of a non-metallic and soft material, such as rubber or other elastomeric material, so that the outer edge of the plate 100 is soft and easier to grip. Moreover, the band 110 being comprised of an elastomeric material avoids or minimizes damage to objects which the plates may come into contact with, such as if the plate is accidentally dropped on the floor. The band 110 can be of a predetermined color, such as the bands 110 of a given weight of plates being one color while the bands 110 of another set of plates 100 of a different weight can be another color so as to more easily visually identify the different weights of the plates 100. The band 110 can also serve to reduce noise when the plates 100 come into contact with one another, such as when being stacked or placed against one another during storage or when being stacked and connected to one another during use.

As illustrated in FIG. 3, an outer face 114 of the band 110 may have a beveled outer face that forms the fingerhold ledge. The beveled face 114 provides an easily grippable surface and area to provide easy access to lift the plate 100.

Two or more plates 100 can be disposed adjacent to one another, in stacking relationship, and detachably connected to one another so that the user may adjust the overall weight he or she is exercising with. Thus, each plate may include at least one connector assembly for detachably connecting one plate to another plate of the set of plates.

For example, the plates 100 may be connected to one another with a strap that attaches to the inside hand grip area 106, or hook and loop tape straps, hook and loop tape dots disposed on generally opposite surfaces of the plates for removable connection, magnets, ball lock bolts, ball lock dowel pin, locking edges, a slip-on U-shaped rubber molded unit that attaches to the inside hand grip area by pushing and slipping into place, thereby securing the adjacent plates or stack of plates to one another. In a particularly preferred embodiment, as illustrated, however, the at least one connector assembly of each plate comprises a first locking member associated with one of the plates and a second locking member associated with an adjacent plate, the locking members cooperatively and releasably connecting the adjacent plates to one another.

With continuing reference to FIGS. 2 and 3, the first locking member may comprise a peg 116 which extends from a surface of its associated plate 100. The peg may comprise a post 118 extending vertically from the surface of the plate 104 and an enlarged head 120 at an end of the post generally opposite the surface of the plate 100. The head 120 may be generally planar so as to be generally parallel with the surface 104 of the plate 100 and thus have a nail-head configuration, as illustrated.

The second locking member may comprise a slot 122 associated with an adjacent plate 100 for receiving at least a portion of the peg 116 of its adjacent plate 100. Such a slot 122 is formed on generally the opposite surface 102 of the plate 100. It will be understood that the one or more pegs 116 and slots 122 are formed on generally opposite surfaces of the plate 100 so as to engage a corresponding peg or slot of an adjacent plate 100.

The slot may comprise a recess having an open-faced aperture 124 comprising an insertion portion configured to receive at least a portion of a peg 116 therein, including the head 120 and at least a portion of the post 118. The slot also includes a locking portion 126 for slidably receiving a portion of the peg, such as the head 120 therein as adjacent plates 100 are rotated with respect to one another. As illustrated in FIG. 3, the slot 122 may have a generally L or T cross-sectional configuration. An open-faced slot of a narrower width than that of the insertion aperture 124 is provided in alignment with the locking portion 126 of the slot 122 so as to enable a portion of the post 118 to be received therein as the plates are rotated with respect to one another and the head 120 rotated into the locking portion 126 of the slot 122. However, this slot 128 is of a reduced diameter and prevents the head 120 of the peg 116 from extending therethrough, locking adjacent plates 100 to one another.

It will be understood that while there may be as few as a single peg 116 and a single slot 122 associated with a plate 100, there can also be a plurality of pegs 116 and 122 associated with each plate. Typically, however, there is a corresponding slot 122 on a surface of an adjacent plate 100 so as to receive a peg 116 extending from the adjacent plate. The connector assembly may comprise a plurality of spaced-apart pegs 116 extending from either the upper or lower surface 102 or 104 of the plate 100, and at least a corresponding number of slots 122 formed in a mirroring arrangement on the opposite surface of the plate 100.

Figure 4:
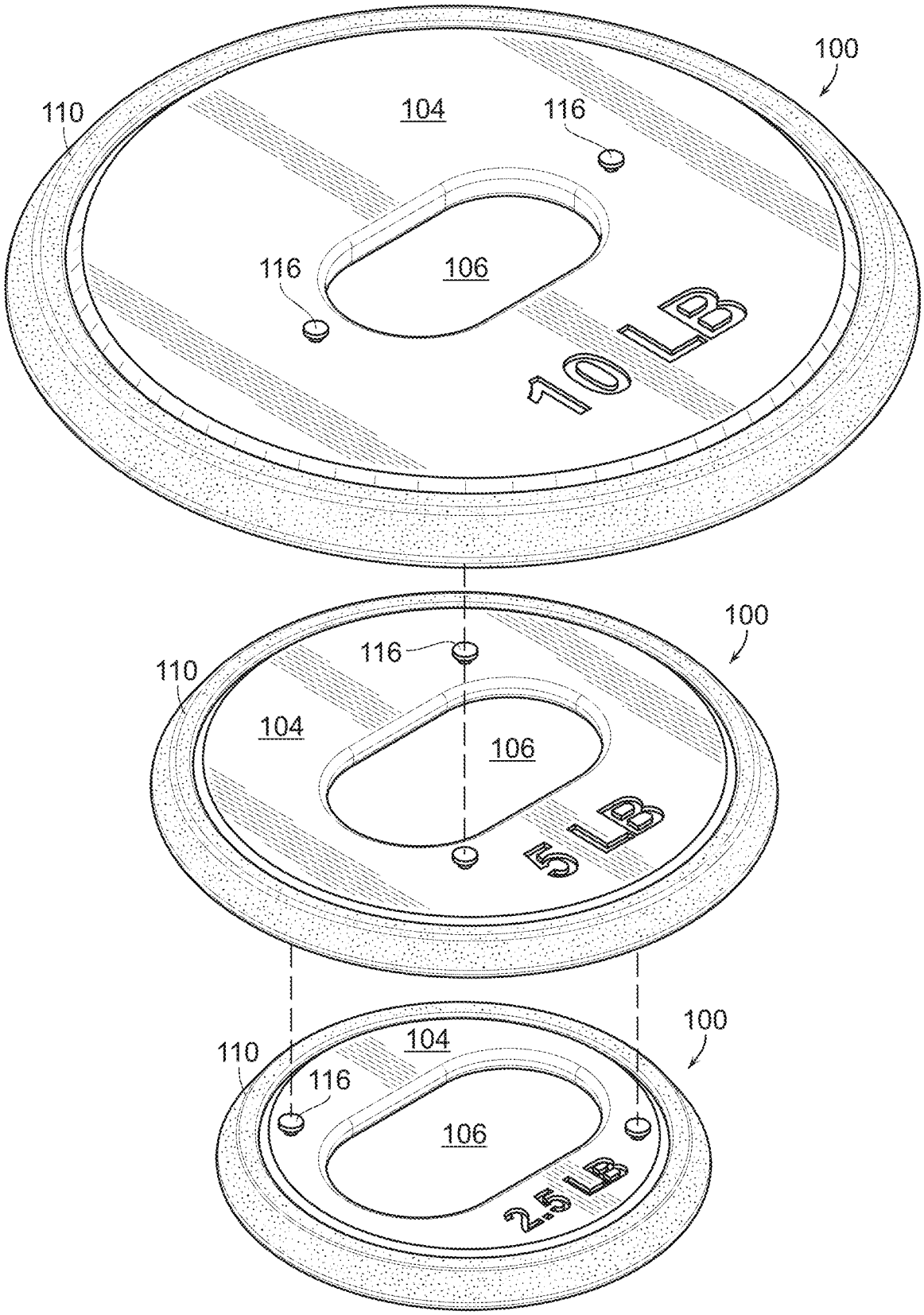
FIG. 4 is an exploded upper perspective view of a plurality of plates to be connected to one another in accordance with the present invention.
Figure 5:
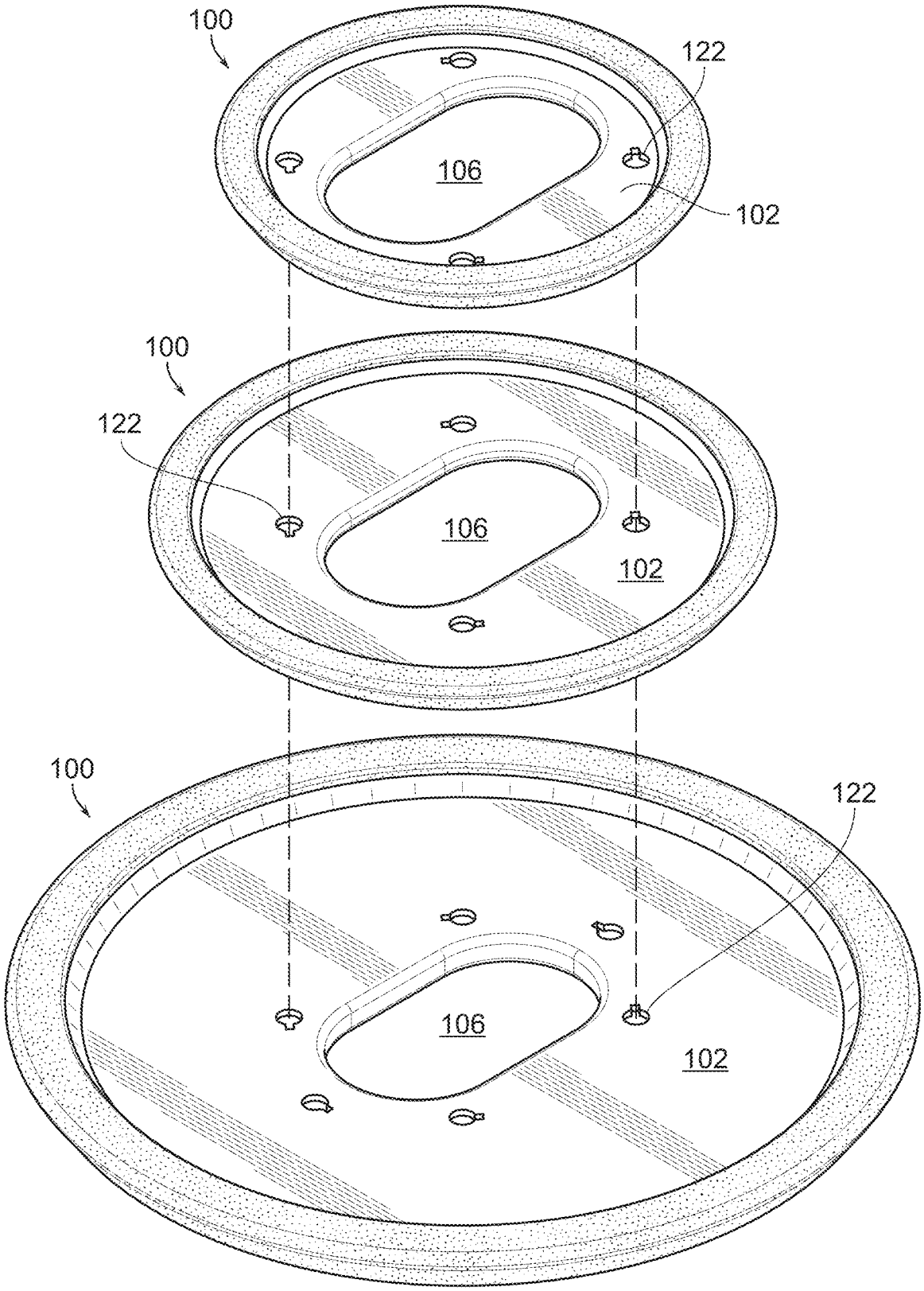
FIG. 5 is a lower perspective view similar to FIG. 4.
Figure 6:
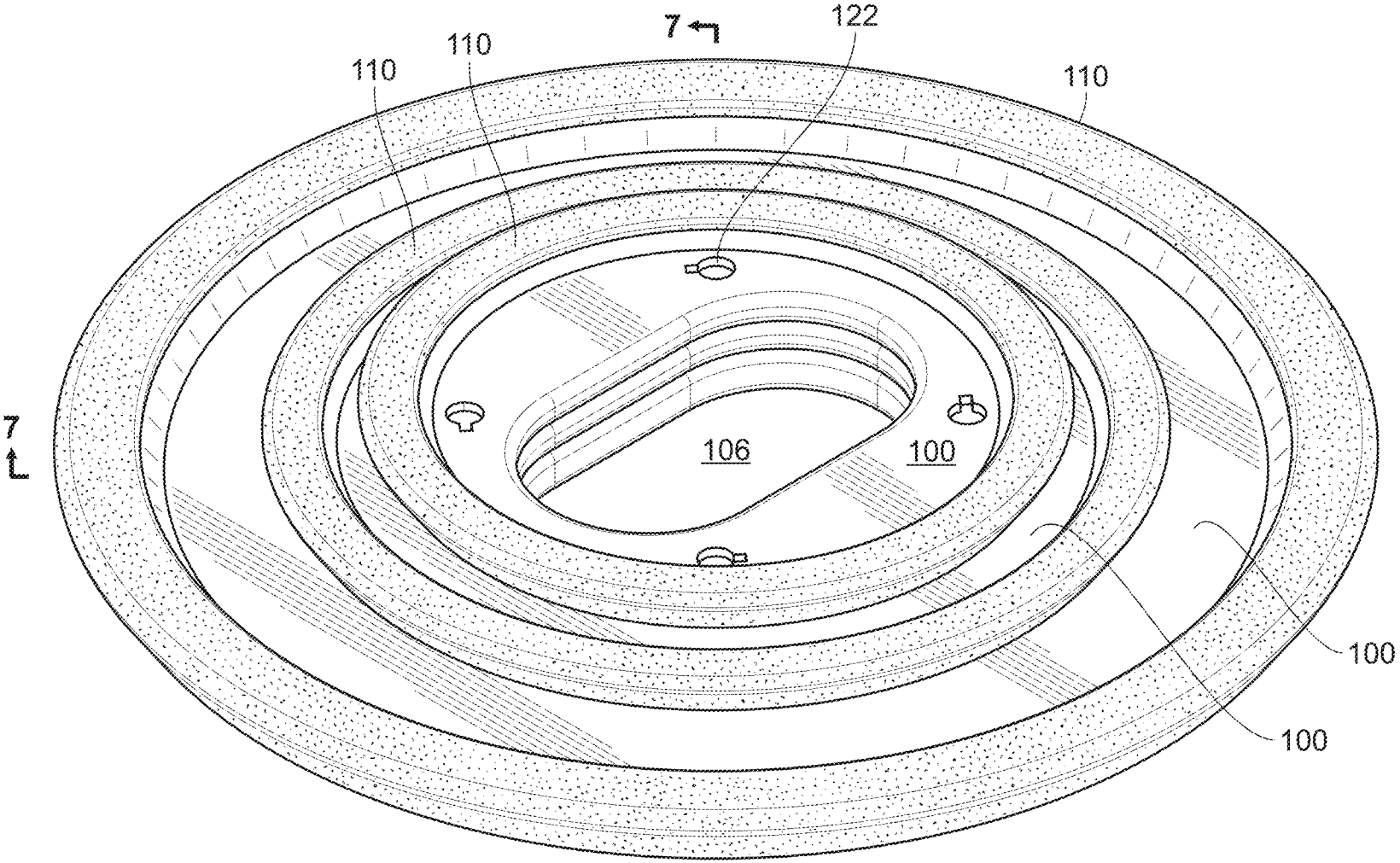
FIG. 6 is a perspective view of the plates of FIGS. 4 and 5 stacked upon and connected to one another, in accordance with the invention.
Figure 7:
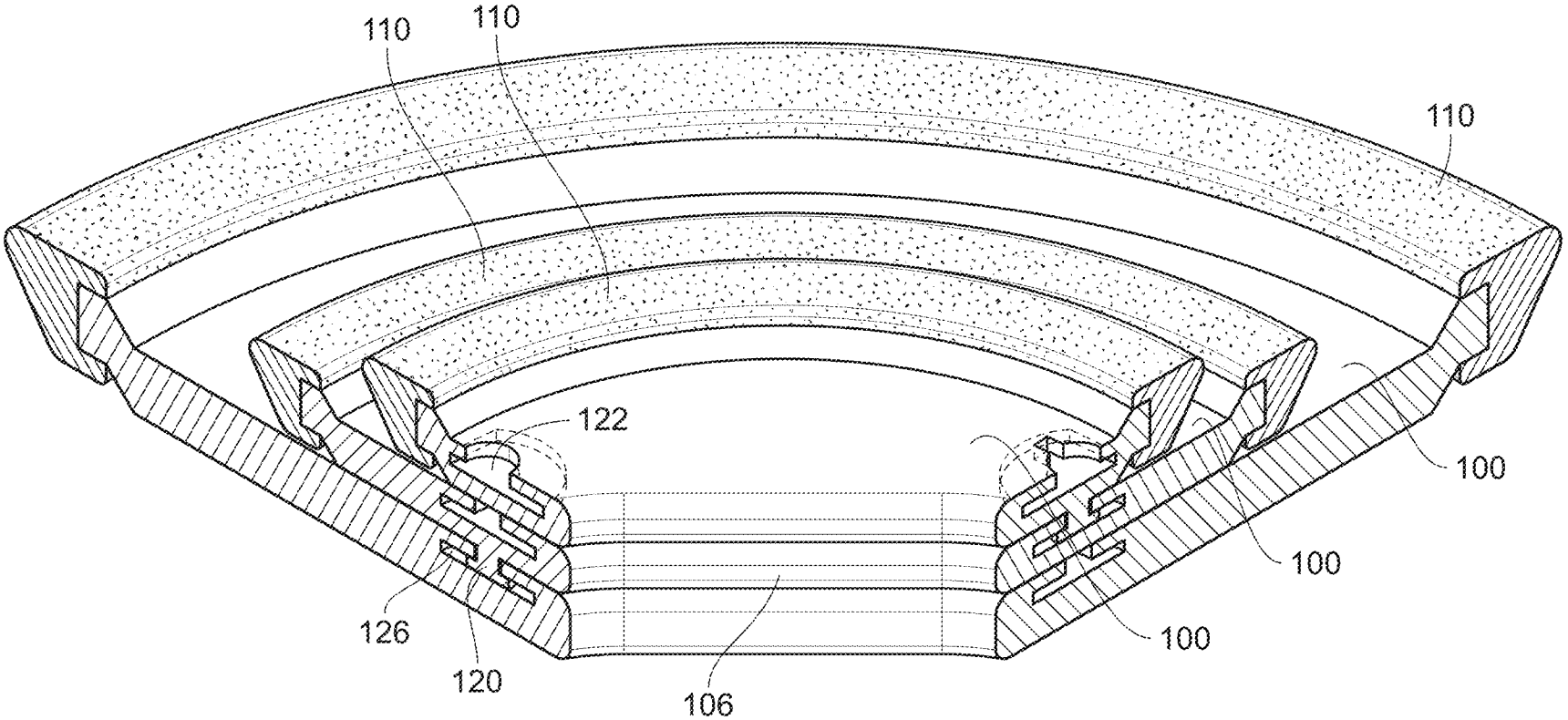
FIG. 7 is a cross-sectional view taken generally along line 7-7 of FIG. 6.

Thus, as illustrated in FIGS. 4 and 5, while there are two pegs 116 extending upwardly from a surface 104 of the plate, there are at least two corresponding slots 122 formed on a generally opposite surface 102 of the plates 100, such that the pegs 116 can be inserted into the slots 122. In the illustrated example, there are four slots 122, which still enables the two pegs 116 to be inserted into two of the four slots. However, there can be an equal number of pegs and slots, with a plurality of pegs and slots creating a more secure locked connection as the plates 100 are stacked upon one another. By inserting the pegs 116 into the insertion aperture 124 portion of the slot 122, and then as the plates 100 are rotated with respect to one another moving a portion of the peg 116, such as the head 120 into the locking portion 126 of the slot 122, as described above, securely connects the plates to one another. The stacking and interconnection of three plates is illustrated in FIGS. 6 and 7. It can be seen that the head portion 120 of the peg 116 has been rotated from the open-faced insertion aperture 124 into the locking portion 126 of the slot 122, connecting the plates 100 to one another. The plates are sufficiently thin and of a configuration so as to enable the stacking of adjacent plates 100 to one another, where they are detachably connected to one another.

Figure 8:
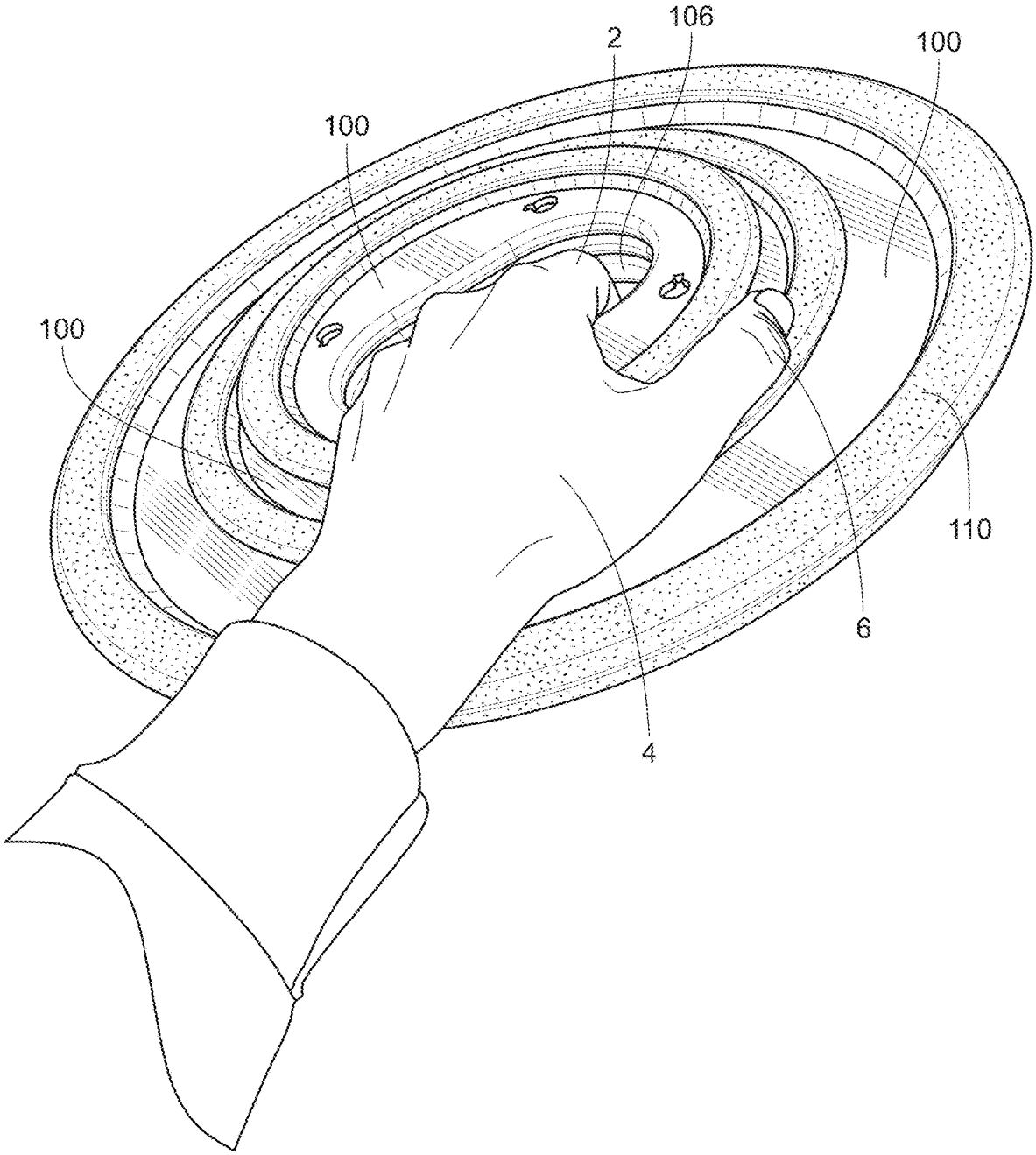
FIG. 8 is a perspective view of a user holding the stack of connected plates of FIG. 6, in accordance with the present invention.

With reference now to FIGS. 6-8, when adjacent plates are placed next to one another, such as in stacked relation, and the pegs 116 of one plate are inserted into the slots 122 of the other, it will be understood that when the plates 100 are rotated with respect to one another, so as to detachably connect them in a locking manner as described above, their handhold apertures 106 come into alignment with one another, as illustrated in FIG. 6. Thus, the aligned handhold apertures 106 form a co-extensive handhold 106 extending through all of the plates 100. This enables the user to insert his or her fingers 2 through the aligned handhold apertures 106 and grasp all of the interconnected plates 100. As described above, the user's four fingers will extend through the handhold aperture such that at least a portion of the fingers, such as the fingertips of the user grasp one surface of the connected set of plates 100, while the user's hand 4 and thumb 6 remain on the opposite surface of the stack of connected plates 100 so as to securely grasp and grip and hold the stack of interconnected plates 100.

In order to detach one or more plates 100 from the stack of plates 100, one or more plates are grasped and rotated so as to move the peg 116 from a locking position, wherein the head 120 is within the locking portion 126 of slot 122 and into the open-faced insertion aperture 124, wherein the one or more plates can be pulled away and detached from the one or more other plates. Two plates may be interconnected in this manner and detached from one another, or a multiple set of plates, such as three or four plates may be interconnected to one another in this fashion. A single plate 100 may be removed from the remaining stack of plates, or multiple plates may be detached from one another at any given time as desired by the user to increase or decrease the amount of weight the user is holding and using to exercise.

As mentioned above, the plates 100 may be created in varying different weights. As an example, one or more weights may weight 2.5 lbs., while others weigh 5 lbs. and yet others 10 lbs., etc. This enables the user to vary the amount of weight, or resistance, that the user performs for the varying exercises. A user having less strength may utilize a single 2.5 lb. plate 100 for performing an exercise, whereas a stronger user may utilize either the 5 lb. or 10 lb. weight for the same exercise. The same user may utilize a single plate of a given weight for one exercise, but a plate of either an increased or decreased weight amount for another exercise.

As described above, the plates 100 may be detachably connected to one another in order to alter and vary the amount of weight that is held by the user. For example, the user may interconnect a 2.5 lb. plate to a 5 lb. plate so as to achieve a total weight of 7.5 lbs. Similarly, the user may attach a 2.5 lb. plate to a 10 lb. plate to achieve 12.5 lbs. total weight, or a 5 lb. weight to a 10 lb. weight so as to achieve 15 lbs. total weight, etc. This is done, as mentioned above, when opposing surfaces of adjacent plates are brought against one another and the one or more pegs 116 of one of the plates is inserted into the slots 122 of the adjacent plate, and the plates are rotated with respect to one another so as to place them in locking interconnection.

The total weight utilized is only limited by the strength of the user and the size and number of the plates 100 available to the user. For example, in a set of plates 100 embodying the system of the present invention having a single 2.5 lb. plate, a single 5 lb. plate, and two 10 lb. plates, the user may hold in his or her hand weights of 2.5 lbs., 5 lbs., 7.5 lbs., 10 lbs., 12.5 lbs., 15 lbs., 17.5 lbs., 20 lbs., 22.5 lbs., 25 lbs., or 27.5 lbs. depending upon the combination of plates 100. This large variation of selectable weight is accomplished with only a total of four plates, in this example. Increasing the number of plates, such as having four 10 lb. weights, four 5 lb. weights and four 2.5 lb. weights, as in the set embodying the system of FIG. 1, enables the user to potentially increase the amount of weight held by his or her hand to a greater total amount of weight, or to hold in each hand of the user a desired amount of weight, which may or may not be equal to one another, depending upon the user's desires. In the embodiment illustrated in FIG. 1, a user could hold as little as 2.5 lbs. in each hand utilizing a single 2.5 lb. weight or increments up to 70 lbs. or 35 lbs. in each hand when it is desired to hold the same amount of weight in each hand. It will be understood that the number of plates and weight illustrated in FIG. 1 is exemplary and can be modified by the amount of weight for the given plates, the increments of weights of the various plates, and the total number of plates.

A plurality of plates 100 may be purchased, or offered in a set or combinable sets, to create a handheld free weight exercise system. This enables the user to stack and interlock plates 100 to allow for multiple variations of weight combinations depending upon the user's ability to hold the stack of plates 100 safely in each hand. However, the plates 100 are extremely storage friendly in that the weights can be stacked upon one another and take a relatively small amount of storage space.

The number of plates 100 or sets of plates can be increased in order to accommodate a large group setting, such as in a gym. A number of plates 100 of varying weights can be provided and users of the group can select the desired plate 100 or combination of plates according to their strength and ability. Yet, once again, the storage space and number of components are significantly reduced in comparison to existing free weight systems.

It is contemplated that a user may easily transport a set of plates to a remote location, such as a park, beach, etc. in order to perform exercises in that location. For example, a strap, such as a nylon strap, not illustrated, may be inserted through the handheld apertures 106 of the plates 100 so as to easily carry and transport the set of plates 100 from one location to another. The desired number of plates could also be interconnected to one another, as described above, and the interconnected set of plates carried and transported from one location to another. The interconnected set of plates may have a strap associated therewith for more easily carrying the set of weights, such as forming a shoulder strap or the like.

The system of the present invention may include a stand or caddy 200, as illustrated in FIG. 1, for conveniently storing the plates 100. The stand 200 may have the generally A-shaped configuration illustrated in FIG. 1 with a generally planar base 202, a back wall 204, that may be vertical or angled, and a front wall 206 that is angled somewhat backwardly towards the back wall 204 so as to place the plates 100 thereon. A shelf 208 may be formed as part of the front wall 206. Given the circular nature of the plates 100 of the present invention, cutouts or depressions 210 may be formed in the base, such as in shelf 208, where a lower portion of a plate may reside to prevent the plate from rolling off of the stand and instead keep it in place. Such cutouts or depressions 210 may be sized and configured to receive the varying sized plates 100. The stand 200 may be of varying sizes depending upon the number of plates 100 to be stored thereon or the number of sets of plates 100 to be stored thereon. For example, the stand 200 may have a shelf 208 of a sufficient size so as to accommodate up to eight 10 lb. discs, and corresponding lesser weights of 5 lb. and 2.5 lb. plates 100 such that the user may be able to purchase two acquire and use two 55 lb. sets for each hand.

While not illustrated, the stand 200 may include a pull-out slide pan that fits inside the stand, between the back and front walls 204 and 206 which may provide additional storage space for workout shoes, water bottles, resistance bands, stretch sleeves, small weighted balls, jumping ropes, etc. Drill holes and/or hooks may be provided in connection with the stand 200 for hanging various items, such as shoes, towels, etc. Concaved area edges of the stand 200 may be perforated for easy fold, strength retention and prevention of splitting. Multiple colored sheets, such as on a perforated elongated rectangular cardboards strip, may be included with each stand 200, allowing the user to select the desired color strip, separate and press fit onto place on the back side of the stand 200, so as to include a logo or the like or other information which is desirable to the user.

Although several embodiments have been described in detail for purposes of illustration, various modifications may be made without departing from the scope and spirit of the invention. Accordingly, the invention is not to be limited, except as by the appended claims.

What is claimed is:

1. A handheld weight exercise system, comprising:

a set of plates, comprising two or more plates each having a different weight in comparison with at least one of the other plates;

wherein each plate includes at least one connector assembly for detachably connecting said plate to another of said plates;

wherein each plate includes a handhold aperture being sized and configured to receive multiple fingers of a user therethrough, the handhold apertures of the two or more plates being alignable with one another when the two or more plates are connected to one another such that the user can grasp and lift and move the two or more connected plates using aligned handholds;

wherein the at least one connector assembly comprises a first looking member and a second locking member associated with each one of said plates, whereby the first locking member of one of the plates of the set of plates detachably connects to the secondi locking member of another plate of the set of plate disposed adjacent thereto to connect the plates another;

wherein each first locking member comprises a peg extending from a surface of the respective plate and wherein each second locking member comprises a slot formed in a generally opposite surface of the respective plate;

wherein each peg comprises a post extending vertically from the surface of the respective plate and an enlarged head at an end of the post opposite the surface of the respective plate, and wherein each slot comprises a recess in the respective plate having an open-faced aperture for receiving the head of the peg of an adjacent plate of the set of plates and a locking portion for slidably receiving the peg of the adjacent plate therein as the plates are rotated with respect to one another to align the handhold apertures and connect the plates.

2. The handheld weight exercise system of claim 1, including an elastomeric band disposed around a periphery of each plate.

3. The handheld weight exercise system of claim 2, wherein each elastomeric band has a beveled outer face forming a fingerhold.

4. The handheld weight exercise system of claim 1, wherein the handhold apertures each have an oblong configuration enabling four fingers of the user to be inserted therethrough.

5. The handheld weight exercise system of claim 1, wherein the plates comprise discs having a circular configuration and generally planar upper and lower surfaces.

6. A handheld weight exercise system, comprising:

a set of plates, comprising two or more plates each having a different weight in comparison with at least one of the other plates;

wherein each plate includes at least one connector assembly for detachably connecting said plate to another of said plates;

wherein each plate includes a handhold aperture which is alignable with the handhold aperture of another plate of the set of plates when the plates are connected to one another enabling a user to grasp aligned handholds and lift and move the connected plates;

wherein the at least one connector assembly comprises a first locking member and a second locking member associated with each of the plates;

wherein each first locking member comprises a peg extending from a surface of the respective plate and each second locking member comprises a slot, wherein the slot associated with one of the plates is configured to receive at least a portion of the peg of another of the plates and connect the plates to one another;

wherein the handhold apertures each have an oblong configuration enabling four fingers of the user to be inserted therethrough;

wherein each peg comprises a post extending vertically from the surface of the respective plate and an enlarged head at an end of the post opposite the surface of the respective plate, and wherein each slot comprise a recess having an open-faced aperture for receiving the head of the peg of an adjacent plate of the set of plates and a locking portion for slidably receiving the peg of the adjacent plate therein as the plates are rotated with respect to one another to align the handhold apertures and connect the plates.

7. The handheld weight exercise system of claim 6, including an elastomeric band disposed around a periphery of each plate.

8. The handheld weight exercise system of claim 7, wherein each elastomeric band has a beveled outer face forming a fingerhold.

9. The handheld weight exercise system of claim 6, wherein the plates comprise discs having a circular configuration and generally planar upper and lower surfaces.

10. A handheld weight exercise system, comprising:

a set of plates, comprising two or more plates each having a different weight in comparison with at least one of the other plates, the plates comprising discs having a circular configuration and generally planar upper and lower surfaces;

wherein each plate includes at least one connector assembly for detachably connecting said plate to another of said plates;

wherein each plate includes a handhold aperture which is alignable with the handhold aperture of another plate of the set of plates when the plates are connected to one another, the handhold aperture of each plate having an oblong configuration enabling four fingers of a user to be inserted therethrough such that the user can grasp and lift and move the connected plates using aligned handholds;

wherein the at least one connector assembly comprises a first locking member and a second locking member associated with each one of said plates, whereby the first locking member of one of the plates of the set of plates detachably connects to the second locking member of another plate of the set of plates disposed adjacent thereto to connect the plates to one another;

wherein each first locking member comprises a peg extending from a surface of the respective plate and wherein each second locking member comprises a slot formed in a generally opposite surface of the respective plate;

wherein each peg comprises a post extending vertically from the surface of the respective plate and an enlarged head at an end of the post opposite the surface of the respective plate, and wherein each slot comprises a recess in the respective plate having an open-faced aperture for receiving the head of the peg of an adjacent plate of the set of plates and a locking portion for slidably receiving the peg of the adjacent plate therein as the plates are rotated with respect to one another to align the handhold apertures and connect the plates.

11. The handheld weight exercise system of claim 10, including an elastomeric band disposed around a periphery of each plate.

12. The handheld weight exercise system of claim 11, wherein each elastomeric band has a beveled outer face forming a fingerhold.

* * * * *